US007478679B2

(12) United States Patent
Berzin et al.

(10) Patent No.: US 7,478,679 B2
(45) Date of Patent: Jan. 20, 2009

(54) FIELD ASSEMBLED PACKER

(75) Inventors: Vel Berzin, Houston, TX (US); Walter J. Laflin, Houston, TX (US); Robert O. Castillo, Stafford, TX (US); Darwin D. Arline, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 29 days.

(21) Appl. No.: 11/634,772

(22) Filed: Dec. 6, 2006

(65) Prior Publication Data

US 2008/0135260 A1 Jun. 12, 2008

(51) Int. Cl.
*E21B 33/12* (2006.01)

(52) U.S. Cl. ..... 166/387; 166/179

(58) Field of Classification Search ..... 166/387, 166/179, 180

See application file for complete search history.

(56) References Cited

U.S. PATENT DOCUMENTS

2007/0125532 A1* 6/2007 Murray et al. ..... 166/179

2007/0295498 A1* 12/2007 Wood et al. ..... 166/179

OTHER PUBLICATIONS

Lovejoy, Shaft Locking Devices, www.lovejoySLD.com, date unknown, 2-3.

Lovejoy, Specialty Couplings, date unknown, SP-23-24.

* cited by examiner

*Primary Examiner*—William P Neuder
(74) *Attorney, Agent, or Firm*—Steve Rosenblatt

(57) ABSTRACT

A field assembled packer or plug features a sleeve of a swelling material, preferably rubber, which is slipped over the tubular. A pair of molds is assembled over the tubular. The molds can accommodate variation in the size and out of roundness of standard API tubulars. An epoxy mixture is formulated on site and pumped into the molds at opposed ends of the sealing element assembly and allowed to set up. The molds are removed and the assembly is ready to be run in the hole as a packer included in a tubular string. The element assembly can include a harder swelling material on opposed ends of the main sealing element to protect the main sealing element from damage during run in.

21 Claims, 1 Drawing Sheet

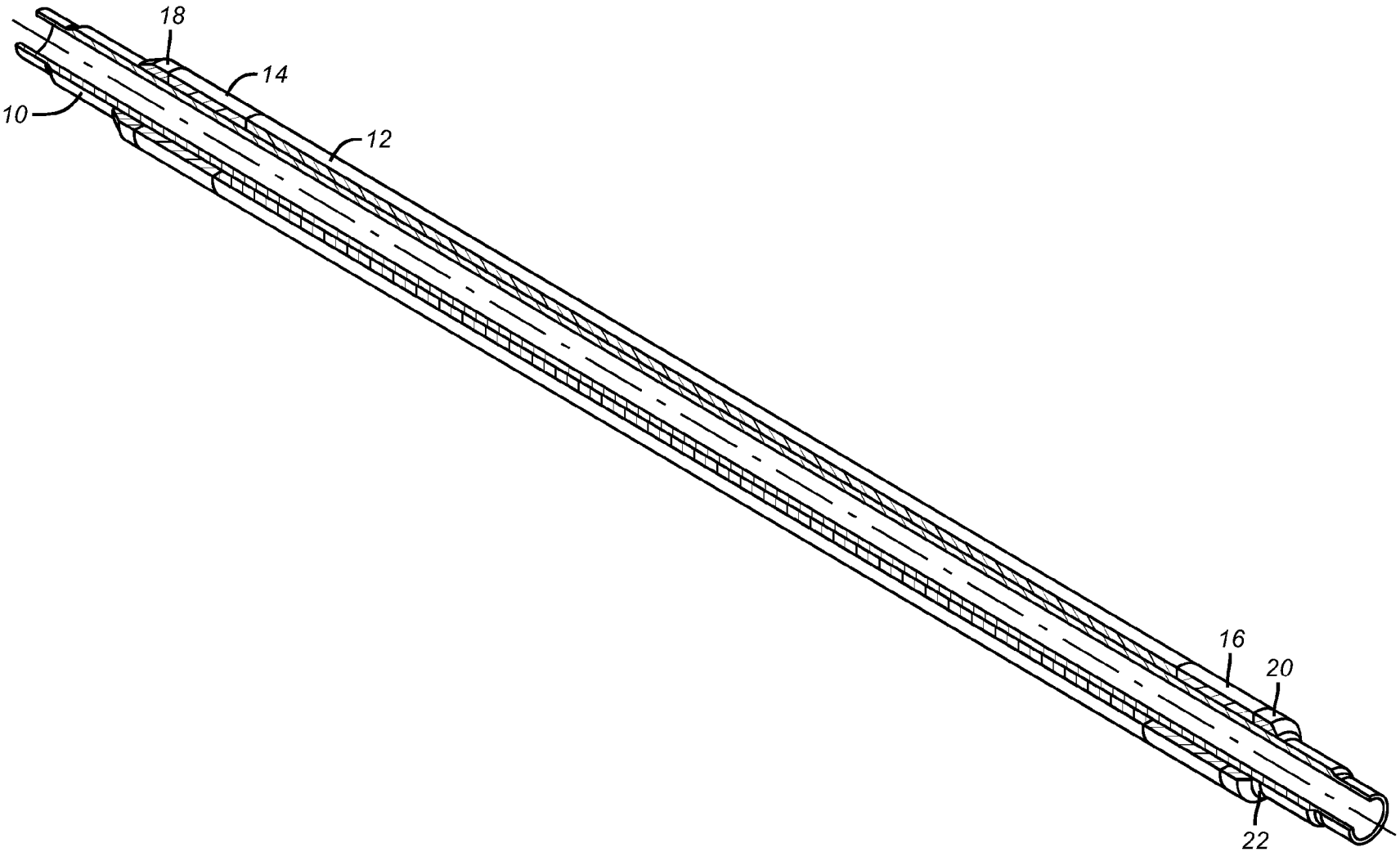
10
18
14
12
16
20
22

FIELD ASSEMBLED PACKER

FIELD OF THE INVENTION

The field of the invention is downhole packers and more particularly field assembled packers that involve a slip on element and field formed retainers.

BACKGROUND OF THE INVENTION

Packers are used downhole to isolate zones in a wellbore from each other. There are many styles currently in use. Some involve set down weight to mechanically compress the sealing element. Others use hydraulic pressure on a piston to compress the sealing element. Yet others use pressurized fluid to inflate an annular space between the mandrel and the sealing element to grow the sealing element radially as its length shortens.

Swelling rubbers have been a more recent development. These packers have to be shop fabricated because of specialized equipment needed to get a bonding relationship between the swelling rubber sleeve and the mandrel. Essentially, the packer assembly that is as long as a tubular section, with the rubber sleeve mounted to it has to be inserted into a long oven and heated to obtain the desired bond to the mandrel. This process is expensive and requires the maintaining of a large inventory of different sizes at remote locations.

Packers that are field assembled have been used in the past. These designs involved a slip on of a tubular shaped cylindrical assembly that had two layers of natural and non-swelling rubber that were separated by a Mylar® sheet to define an inflatable annular space between the layers. Tubing would be connected to the annular space to deliver the inflation fluid. To keep the element from shifting, a hinged clamp was made up over the tubular and disposed at opposed ends of the slipped on element assembly. There were many problems with this design that date back to the 1970s. Apart from issues of over inflation leading to a rupture of the element assembly, the clamps proved unreliable. The vibration in a tubular string that is inherent to its use downhole made the bolted connections on the clamp release. Apart from that, the clamps were damaged during run in by striking the wellbore. The design was discontinued.

Ring structures have been formed in place for tubulars to serve as centralizers for such purposes as to keep the tubular centralized for cementing in deviated wells.

What is needed and provided by the present invention is a packer design that can be field assembled using, preferably, an element assembly that swells downhole to create a seal. It is retained to the mandrel by rings that are formed to the tubular so that variations in the outer dimensions of the tubular become unimportant. The assembly can further feature different swelling materials to protect the ends of the main swelling material during run in. These and other aspects of the present invention will be more apparent to those skilled in the art from a review of the description of the preferred embodiment and the associated drawing that appear below, while recognizing that the full scope of the invention is to be found in the claims.

SUMMARY OF THE INVENTION

A field assembled packer or plug features a sleeve of a swelling material, preferably rubber, which is slipped over the tubular. A pair of molds is assembled over the tubular. The molds can accommodate variations in the size and out of roundness of standard API tubulars. An epoxy mixture is formulated on site and pumped into the molds at opposed ends of the sealing element assembly and allowed to set up. The molds are removed and the assembly is ready to be run in the hole as a packer included in a tubular string. The element assembly can include a harder swelling material on opposed ends of the main sealing element to protect the main sealing element from damage during run in.

BRIEF DESCRIPTION OF THE DRAWING

FIG. 1 is a perspective view in part section of the field assembled packer of the present invention.

DETAILED DESCRIPTION OF THE PREFERRED EMBODIMENT

FIG. 1 illustrates a tubular mandrel 10 which can be an API tubular and intended to be part of a string to go into a wellbore. A main sealing element 12 is slipped over the tubular 10 at a field location. Preferably, the element 12 is a swelling rubber material but other materials that swell downhole on exposure to well fluids or conditions could be used instead. The element 12 should have an inside diameter that allows for rapid installation at the well location without using excessive clearance. An interference fit could also be used with lubricant or compressed gas to aid in rapid assembly.

The main element 12 can be optionally protected at one or both opposed ends by a harder swelling material sleeve such as 14 or 16. To some extent the sleeves 14 and 16 can act as extrusion barriers to the main element 12. Swellable plastic polyurethane is the preferred material. It can be used at opposed ends, as shown, or just at either end or even to break up sections of the element 12.

The assembly is completed with rings 18 and 20 that act as opposed travel stops and extrusion barriers for the assembly of element 12 and sleeves 14 and 16, in the embodiment shown in FIG. 1. Rings 18 and 20 can be made of steel and slipped over an end of the tubular 10 and attached with spot welds 22. Alternatively, the rings 18 and 20 can be formed in place by applying a mold over the tubular 10 and mixing a two part epoxy, for example, and pumping it into the mold to allow it to set up and bond to the tubular 10. Of course, the tubular surface 10 would have to be prepared such as by sanding with a sander or sandpaper. The material selection could be changed as long as the formed ring properly adheres to the tubular 10. As a result of using the mold and an associated pumping step the end result upon setting up of the material is that a unitary ring is formed that can keep the assembly of element 12 and sleeves 14 and 16 from shifting. Combinations of a steel ring and an epoxy ring for rings 18 and 20 are contemplated.

Those skilled in the art will appreciate that a great deal of time and expense are realized by not having to form packers that use a swelling material at a remove location using large autoclaves to ensure proper bonding to the mandrel body. Expensive inventory that is heavy and costly to transport is also eliminated. In view of field assembly, damage in transport is less likely to occur. Shipping costs to remote well sites are reduced as the heavy mandrels are not shipped but are already found at the site. The packer assembly can be rapidly assembled regardless of the actual outer dimensional variations in a particular tubular. Restraints on either end are also quickly deployed with the main delay being the time for curing if an epoxy mixture is used. In the alternative, flexible rings that can be slipped onto the tubular 10 and can flex to accommodate dimensional imperfections can also be used. These rings can be closed or split to facilitate rapid assembly and fixation. Other materials than steel such as composites, plastics or epoxies can be used for travel stops. Preferably, the radial extension of the rings 18 and 20 is at least as large as the element 12 or sleeves 14 and 16.

The above description is illustrative of the preferred embodiment and many modifications may be made by those skilled in the art without departing from the invention whose scope is to be determined from the literal and equivalent scope of the claims below.

We claim:

1. A method of field assembling a packer or plug, comprising:

sliding a sealing element that swells downhole when exposed to well fluids over a mandrel;

securing at least one travel stop for the element to the mandrel;

delivering the assembly of said mandrel, travel stop and sealing element downhole; and allowing said element to swell to create a seal downhole.

2. The method of claim 1, comprising:

forming the travel stop on the mandrel.

3. The method of claim 1, comprising:

using a ring as said travel stop.

4. The method of claim 3, comprising:

forming said ring from metal, plastic or a composite material.

5. A method of field assembling a packer or plug, comprising:

sliding a sealing element that swells downhole when exposed to well fluids over a mandrel;

securing at least one travel stop for the element to the mandrel;

delivering the mandrel downhole;

allowing said element to swell to create a seal downhole;

forming the travel stop on the mandrel;

mounting a mold around the mandrel;

filling the void enclosed by said mold with a hardening material that adheres to said mandrel to form said travel stop.

6. The method of claim 5, comprising:

using a two part epoxy for said hardening material.

7. The method of claim 5, comprising:

cleaning the surface of the mandrel before mounting said mold.

8. The method of claim 7, comprising:

sanding said surface of said mandrel before mounting said mold.

9. A method of field assembling a packer or plug, comprising:

sliding a sealing element that swells downhole when exposed to well fluids over a mandrel;

securing at least one travel stop for the element to the mandrel;

delivering the mandrel downhole;

allowing said element to swell to create a seal downhole;

using a ring as said travel stop;

forming said ring from steel; and attaching it to said mandrel by welding.

10. A method of field assembling a packer or plug, comprising:

sliding a sealing element that swells downhole when exposed to well fluids over a mandrel;

securing at least one travel stop for the element to the mandrel;

delivering the mandrel downhole;

allowing said element to swell to create a seal downhole;

using a ring as said travel stop;

forming said ring from metal, plastic or a composite material;

providing a split in said ring.

11. A method of field assembling a packer or plug, comprising:

sliding a sealing element that swells downhole when exposed to well fluids over a mandrel;

securing at least one travel stop for the element to the mandrel;

delivering the mandrel downhole;

allowing said element to swell to create a seal downhole;

providing a sleeve adjacent at least one end of said element; and making said sleeve harder than said element.

12. The method of claim 11, comprising:

making said sleeve from a material that swells when exposed to well fluids.

13. The method of claim 12, comprising:

forming said sleeve to extend radially at least as far as said element.

14. The method of claim 13, comprising:

forming said travel stop to extend radially at least as far as said sleeve.

15. The method of claim 12, comprising:

using two sleeves near opposed ends of said element; and securing a travel stop adjacent each said sleeve.

16. The method of claim 15, comprising:

forming the travel stop on the mandrel.

17. The method of claim 16, comprising:

mounting a mold around the mandrel;

filling the void enclosed by said mold with a hardening material that adheres to said mandrel to form said travel stop.

18. The method of claim 17, comprising:

using a two part epoxy for said hardening material.

19. The method of claim 18, comprising:

using metal rings as said travel stops;

spot welding said rings to the mandrel.

20. The method of claim 18, comprising:

providing a split in said rings.

21. A method of field assembling a packer or plug, comprising:

sliding a sealing element that swells downhole when exposed to well fluids over a mandrel;

securing at least one travel stop for the element to the mandrel;

delivering the mandrel downhole;

allowing said element to swell to create a seal downhole;

using said travel stop as an extrusion barrier for said element after it swells.

* * * * *